US006366745B1

(12) United States Patent
Adachi et al.

(10) Patent No.: US 6,366,745 B1
(45) Date of Patent: Apr. 2, 2002

(54) IMAGE FORMING APPARATUS HAVING A MECHANISM TO CLEAN A DRIVING ROLLER BY A RECORDING MATERIAL

(75) Inventors: Nobukazu Adachi; Yasumasa Otsuka, both of Yokohama; Toshihiko Ochiai, Tokyo; Seietsu Miura, Abiko; Mahito Yoshioka, Toride; Takeshi Niimura; Kenji Karashima, both of Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/668,463

(22) Filed: Sep. 25, 2000

(30) Foreign Application Priority Data

Sep. 30, 1999 (JP) ..... 11-279902

(51) Int. Cl.[7] ..... G03G 15/20
(52) U.S. Cl. ..... 399/68; 399/327; 399/328
(58) Field of Search ..... 399/68, 98, 99, 399/322, 327, 328, 400; 347/156

(56) References Cited

U.S. PATENT DOCUMENTS

| | | | | |
|---|---|---|---|---|
| 5,083,168 A | | 1/1992 | Kusaka et al. | 399/329 |
| 5,264,902 A | | 11/1993 | Suwa et al. | 399/333 |
| 5,300,997 A | | 4/1994 | Hirabayashi et al. | 399/329 |
| 5,390,012 A | | 2/1995 | Miyashiro et al. | 399/303 |
| 5,508,796 A | | 4/1996 | Sasam et al. | 399/18 |
| 5,621,451 A | | 4/1997 | Sugiura et al. | 347/112 |
| 5,623,331 A | * | 4/1997 | Kaneko et al. | 399/328 |
| 5,819,149 A | | 10/1998 | Watanabe et al. | 399/330 |
| 5,907,745 A | | 5/1999 | Azuma et al. | 399/92 |
| 6,094,559 A | * | 7/2000 | Otsuka et al. | 399/327 |

FOREIGN PATENT DOCUMENTS

| | | | |
|---|---|---|---|
| JP | 63-313182 | | 12/1988 |
| JP | 2-157878 | | 6/1990 |
| JP | 09-236996 | * | 9/1997 |

* cited by examiner

*Primary Examiner*—Sophia S. Chen
(74) *Attorney, Agent, or Firm*—Fitzpatrick, Cella, Harper & Scinto

(57) ABSTRACT

The present invention provides an image forming apparatus which has an image bearing member for bearing an image, a transferring member for forming a transfer nip portion between the image bearing member and the transferring member, wherein a recording material is pinched and conveyed and an image on the image bearing member is transferred onto the recording material in the transfer nip portion, a rotary member contacted with the image on the recording material, and a driving roller for forming a fixing nip portion between the rotary member and the driving roller and for driving the rotary member, wherein the recording material bearing the image is pinched and conveyed and the image is fixed to the recording material in the fixing nip portion, and wherein regarding at least a recording material having a maximum size, while the image is being transferred in the transfer nip portion, the image is fixed in the fixing nip portion, and wherein a peripheral speed of the driving roller is always greater than a conveying speed of the recording material in the transfer nip portion.

5 Claims, 4 Drawing Sheets

IMAGE FORMING APPARATUS HAVING A MECHANISM TO CLEAN A DRIVING ROLLER BY A RECORDING MATERIAL

BACKGROUND OF THE INVENTION

1. Field of the Invention

The present invention relates to an image forming apparatus such as a copying machine, a printer and the like, and more particularly, it relates to a fixing apparatus for pinching and conveying a recording material.

2. Related Background Art

In conventional image forming apparatuses of this kind such as laser beam printers, copying machines and the like, generally, a toner image born on an image bearing member such as a photosensitive drum is transferred onto a recording material such as a paper by a transferring process and is fixed to the recording material as a permanent image by a fixing process.

In this fixing process, a heating device for fixing the toner image to the recording material by heat and fusion is used, in which the recording material is pinched and conveyed by a heating roller a temperature of which is maintained to a predetermined value, and a pressing roller having an elastic layer and urged against the heating roller, so that the non-fixed toner image is fixed to the recording material.

On the other hand, recently, in plate of such a fixing process, film fixing apparatuses capable of increasing a temperature for a short time from power-ON, such as fixing apparatuses as disclosed in Japanese Patent Application Laid-Open Nos. 63-313182 and 2-157878 have been proposed.

An example of a fixing apparatus as a background art of the present invention is shown in FIG. 4. In this fixing apparatus, by heating and pressurizing a recording material by a fixed heating body 202, a heat-resistive film 201 (referred to as "fixing film" hereinafter) conveyed while being opposed to and urged against the heating body 202, and a pressing roller 205 urged against the heating body 202 via the fixing film 201, a non-fixed toner image on the recording material is fixed to the recording material.

However, a small amount of non-fixed toner is not fixed to the recording material but is adhered to the fixing film 201. The toner adhered to the film 201 is transferred from the film 201 to a surface of the pressing roller 205.

Since the surface of the pressing roller 205 is covered by fluororesin (fluorine resin) so that the toner is hard to be adhered thereto, the toner adhered to the surface of the pressing roller 205 is adhered to a back surface of a next recording material while the recording material is being passed through a fixing nip portion. Accordingly, the toner was not almost accumulated on the surface of the pressing roller 205.

By the way, in recent years, neutral papers have been used as recording material for the purpose of long term storage, with the result that usage of papers including calcium carbonate as a filler have been increased.

It is known that toner is hard to be adhered to calcium carbonate, and, thus, when the papers including calcium carbonate are passed though the fixing apparatus as the recording materials, since the toner on the pressing roller 205 is hard to be adhered to the recording material, the toner is gradually accumulated on the surface of the pressing roller 205. In this condition, when the fixing apparatus continues to be used, the toner is stuck to the surface of the pressing roller 205 to contaminate the latter.

Further, usage of papers including talc as main material has also been increased. Such a paper is apt to generate paper powder. Even when a large amount of paper powder exists on the surface of the paper, there is the tendency for making adhesion of toner difficult. Accordingly, when the talc papers continue to be used, the toner adhered to the pressing roller becomes hard to be returned to the recording material, with the result that the toner is accumulated on and stuck to the surface of the pressing roller 205.

Particularly, in the transferring process utilizing a transfer roller, while a peripheral speed of the transfer roller is set to be greater than a conveying speed of the paper to enhance transferring efficiency, by doing so, the paper powder is apt to be generated on the back surface of the recording material, with the result that, since the toner on the pressing roller 205 is hard to be adhered to the back surface of the recording material, the toner will be further accumulated on the surface of the pressing roller 205.

To avoid this, as shown in FIG. 4, it is considered that a cleaning member 220 is contacted with the surface of the pressing roller 205 to remove the toner.

However, in such a case, if a certain number of recording materials are passed, the contamination will be accumulated on the cleaning member 220, an such contamination passes through the cleaning member 220 to be adhered to the recording material. Thus, when the contamination is accumulated to some extent, the cleaning member must be exchanged periodically.

Further, if the exchange is forgotten, the cleaning efficiency will be insufficient. Consequently, the toner is stuck to the surface of the pressing roller 205 and the paper is adhered to such toner, with the result that paper jam on the pressing roller occurs, and, in some cases, it becomes difficult to remove the recording material from the pressing roller 205, thereby requiring repair.

Further, there is a problem that the surface of the pressing roller 205 is damaged by sliding contact between the cleaning member 220 and the pressing roller.

SUMMARY OF THE INVENTION

An object of the present invention is to provide an image forming apparatus in which a surface of a driving roller is cleaned by a recording material efficiently.

Another object of the present invention is to provide an image forming apparatus comprising an image bearing member for bearing an image, a transferring member for forming a transfer nip portion between the image bearing member and the transferring member, a rotary member contacted with an image on a recording material, and a driving roller for forming a fixing nip portion between the rotary member and the driving roller and for driving the rotary member, wherein the recording material is pinched and conveyed and the image on the image bearing member is transferred onto the recording material in the transfer nip portion, and wherein the recording material bearing the image thereon is pinched and conveyed and the image is fixed to the recording material in the fixing nip portion, and, when the image is transferred in the transfer nip portion, the image is fixed to at least a recording material having maximum size in the fixing nip portion, and a peripheral speed of the driving roller is always greater than a conveying speed of the recording material in the transfer nip portion.

The other object of the present invention is to provide a cartridge and image forming apparatus, in which information regarding execution of the correction sequence is stored in the cartridge.

DETAILED DESCRIPTION OF THE PREFERRED EMBODIMENTS

The present invention will now be fully explained exemplarily in connection with embodiments thereof with reference to the accompanying drawings. However, dimensions, materials, configurations and relative arrangements of constructural elements described in the embodiments should be altered appropriately in accordance with various conditions such as a construction of an apparatus to which the present invention is applied, and the present invention is not limited to the embodiments described hereinbelow.

First embodiment

Figure 1:
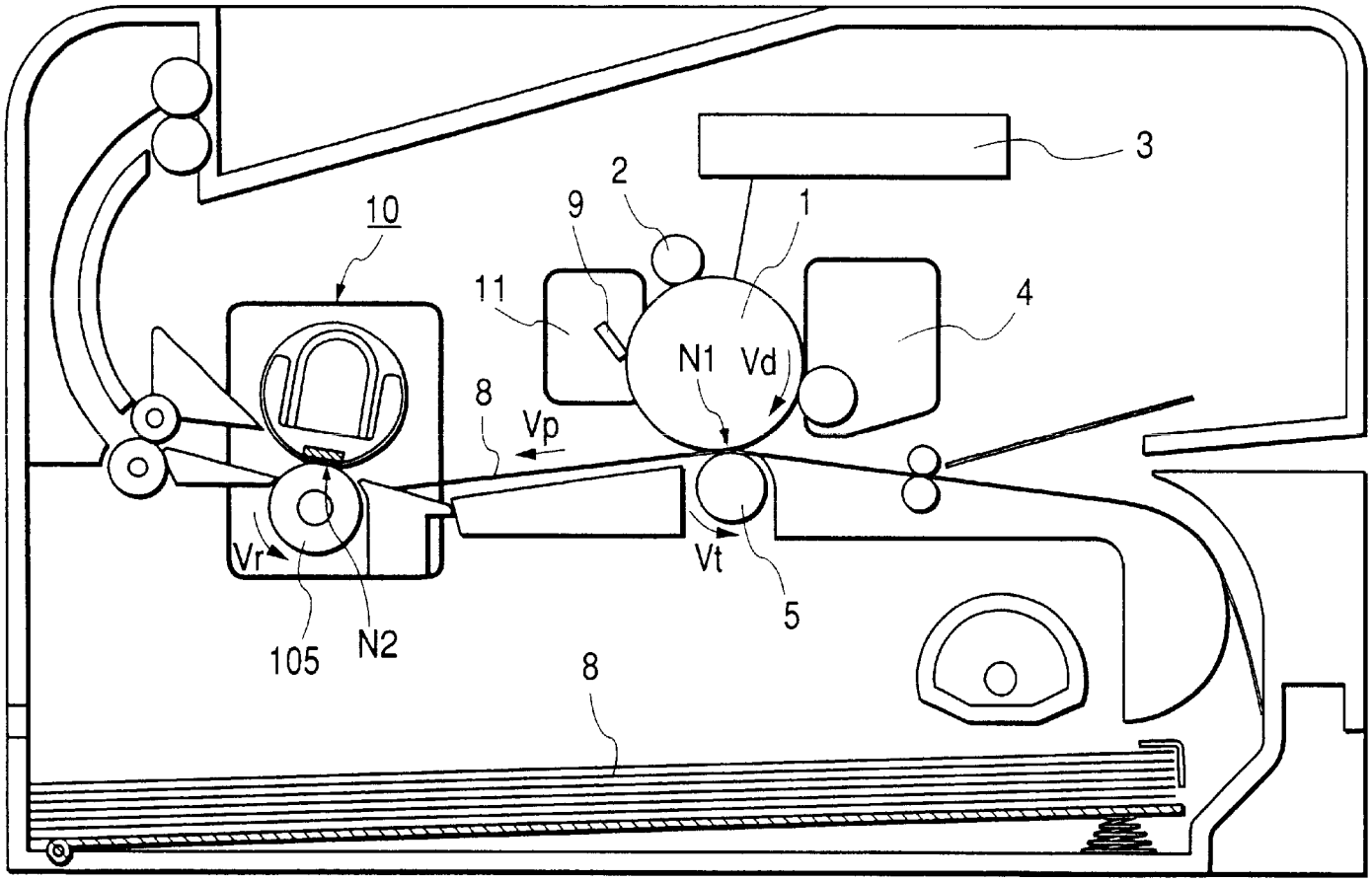
FIG. 1 is a view showing an image forming apparatus according to an embodiment of the present invention.

Now, an image forming apparatus according to a first embodiment of the present invention will be explained with reference to FIGS. 1 and 2. FIG. 1 is a schematic sectional view of the image forming apparatus according to the first embodiment.

In FIG. 1, the image forming apparatus includes a photosensitive drum 1 as an electrostatic latent image bearing member, which is rotated in a direction shown by the arrow and is uniformly charged by a charging device 2.

A laser emitting device 3 serves to illuminate a laser beam onto the uniformly charged photosensitive drum 1 to form an electrostatic latent image thereon. The electrostatic latent image is developed as a toner image by a developing apparatus 4, and the toner image is transferred onto a recording material 8 by a transfer roller 5 as a transferring member.

The transfer roller 5 is urged against the photosensitive drum 1 and is driven to pinch and convey the recording material 8 in a transfer nip portion N1. When it is assumed that a surface speed Vd of the photosensitive drum 1 is 100%, a surface speed Vt of the transfer roller is set to about 105%.

However, since the recording material 8 has strong close contact with the photosensitive drum 1, a conveying speed Vp of the recording material 8 conveyed by the transfer roller 5 (conveying speed of the recording material in the transfer nip portion) approximates the surface speed of the photosensitive drum 1 and is about 101%.

Accordingly, the transfer roller 5 is always slidingly contacted with a back surface of the recording material 8. Incidentally, toner (developer) not transferred and remaining on the photosensitive drum 1 is removed by a cleaning blade 9 and is collected into a waste toner container 11. The cleaned photosensitive drum 1 is subjected to the above-mentioned processes again for next image formation (image forming means).

A fixing apparatus 10 as fixing means serves to fix the non-fixed toner image to the recording material 8 as a permanent image. A construction of the fixing apparatus 10 is shown in FIG. 2.

Figure 2:
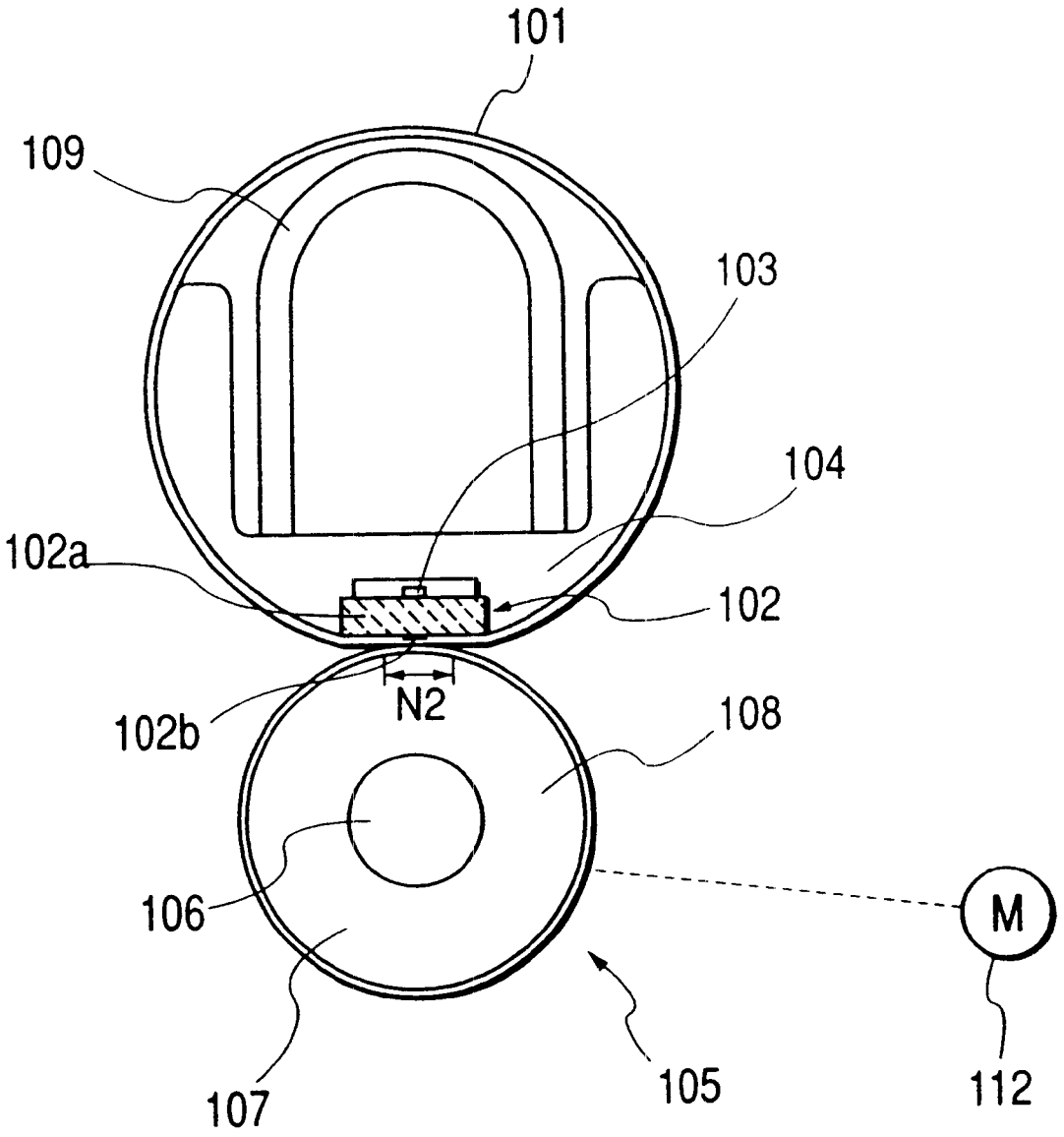
FIG. 2 is a view showing a fixing apparatus.

In FIG. 2, the fixing apparatus includes a cylindrical (heat-resistive) film 101 comprising a polyimide film as a base layer having a thickness of 40 to 60 microns and a PFA layer as a mold releasing layer (releasing layer) having a thickness of about 10 to 20 microns disposed on outer peripheral surface (contacted with the paper and the toner).

A heater 102 as a heating body is constituted by an insulative ceramic substrate 102*a* having a longitudinal direction perpendicular to a conveying direction of the recording material 8, a resistance heat generating body 102*b* screen-printed on the surface of the ceramic substrate along the londitudinal direction thereof and generating heat by energization, and a temperature detecting element (thermistor) 103 disposed on a surface of the ceramic substrate opposite to the resistance heat generating body.

A film guide 104 serves to guide the film while holding the heater 102 and fixedly support the heater 102 so that the heat generating body is exposed. The temperature of the heater 102 is maintained to predetermined value by controlling energization to the heater 102 by means of a temperature control circuit (not shown) on the bases of output from the temperature detecting element 103. Heat-resistive grease is coated on the surface of the film 101 contacted with the heater 102.

A pressing roller 105 as a driving roller is constituted by metal core 106, and a heat-resistive silicone rubber 107. A diameter of the roller is 20 mm (ϕ20), and a surface of the silicone rubber is coated by a fluororesin layer 108 as a mold releasing layer having excellent mold releasing ability with respect to the toner.

A reinforcing metal plate 109 for the film guide is designed to define a fixing nip portion N2 between the pressing roller 105 and the metal plate by applying a load of about 10 kg to the film guide 104 holding the heater 102. Namely, the heater and the pressing roller are urged against each other with the interposition of the film, thereby forming the fixing nip portion N2 between the film and the pressing roller.

Further, the film 101 is selected so that at least inner peripheral diameter thereof becomes greater than a peripheral length of the film guide 104 including the rein forcing stay 109. Namely, the film is loosely mounted around the film guide and the stay.

Further, the pressing roller 105 is driven by portion (drive motor) 112 as driving means. A surface speed Vr of the recording material contacting surface of the pressing roller 105, i.e., peripheral speed of the pressing roller is set to be always greater than a conveying speed Vp of the recording material 8. Namely, in a condition that the photosensitive drum, transfer roller and pressing roller are risen to predetermined speeds, the peripheral speed of the pressing roller is always greater than the speed of the recording material in the transfer nip portion.

In the illustrated embodiment, the peripheral speed Vr of the pressing roller is about 103% of the peripheral speed Vd of the photosensitive drum 1 and is greater than the conveying speed Vp of the recording material by about 2%. A relationship between the speed Vt of the transfer roller 5 and the speed Vr of the pressing roller 105 is not particularly defined, and either speed may be faster than the other.

With the arrangement as mentioned above, when the recording material 8 is inserted between the film 101 and the pressing roller 105, the recording material 8 is conveyed by the pressing roller 105, and the film is rotatingly driven by the recording material 8.

The non-fixed toner on the recording material 8 is heated by the heat from the heater through the film in the fixing nip portion N2 and, at the same time, is pressurized, thereby fixing the toner image to the recording material. The film is contacted with the surface of the recording material on which the non-fixed toner is born, and the pressing roller is contacted with the opposite surface of the recording material.

A distance from the transfer nip portion N1 between the photosensitive drum 1 and the transfer roller 5 to the fixing nip portion N2 between the film 101 and the pressing roller 105 is about 150 mm, so that, when a recording material having A4 size is conveyed, about a half of the recording material is pinched simultaneously and is conveyed.

In this arrangement, the image is formed on the recording material by the transferring process and the fixing process. After the transferring, the recording material 8 is directed into the fixing nip portion N2, and the same recording material is simultaneously pinched in the transfer nip portion N1 and the fixing nip portion N2 and is conveyed. Namely, regarding at least the recording material having the maximum size, while a portion of the image is being transferred in the transfer nip portion, a portion of the image is fixed to the recording material in the fixing nip portion.

Since the conveying speed of the recording material in the fixing nip portion N2 is set to be greater than the conveying speed in the transfer nip portion N1 by about 2%, during from the transferring to the fixing, tension is applied to the recording material 8 due to difference in speed between the transfer nip portion N1 and the fixing nip portion N2. In this case, the pressing roller is slightly slipped with respect to the recording material.

Particularly, since the surface of the pressing roller 105 is coated by the fluororesin layer 108, the pressing roller has smaller coefficient of friction to be slipped easily between the roller and the recording material 8. Thus, the slip is generated between the recording material 8 and the pressing roller 105 in the fixing nip portion N2.

Accordingly, while the recording material 8 is being conveyed while being pinched simultaneously by the fixing nip portion and the transfer nip portion, when it is assumed that the conveying speed of the recording material 8 is Vp', although the speed Vp' becomes greater than the speed Vp since the recording material 8 is pulled by the fixing apparatus 10, because there is the slip between the surface of the pressing roller 105 and the recording material 8, the speed Vp' becomes smaller than the speed Vr.

Now, considering the speed relationships, the following relationships are established:

$Vd<Vp<Vp'<Vt$ $Vp<Vp'<Vr$.

As a result, if the non-fixed toner adhered to the fixing film is transferred to the pressing roller 105, the transferred toner will be frictionally removed by the recording material 8.

Since the diameter of the pressing roller 105 is 20 mm, the recording material having A4 size is conveyed by about 150 mm while being pinched simultaneously and a recording material having LTR size is conveyed by about 130 mm while being pinched simultaneously. Thus, when these recording materials are passed through the fixing apparatus, the surface of the recording material is frictionally slid by an amount corresponding to two revolutions of the pressing roller.

As a result, the toner can be prevented from being stuck to the surface of the pressing roller 105. Although the frictionally removed paper powder and toner are adhered to the back surface of the paper and are discharged, since the amount thereof is small, if they are discharged on the recording material, they are not highlighted not to cause any practical problem.

Incidentally, in order to prevent the toner from being stuck on the surface of the pressing roller 105, it is desirable that the recording material is conveyed by the pressing roller 105 by an amount corresponding to one revolution of the roller or more in a condition that the recording material is simultaneously pinched by the transfer roller 5 and the pressing roller 105.

Further, a tube made of fluororesin such as PFA may be fitted on the surface of the pressing roller 105.

In this way, according to the illustrated embodiment, by setting the speed of the recording material contacting surface of the pressing rotary member to be always greater than the conveying speed of the recording material in the transfer nip portion, since the slip is generated between the pressing rotary member and the recording material so that the recording material is slidingly contacted with the surface of the pressing rotary member to remove the developer adhered to the surface of the pressing rotary member, the developer can be prevented from being stuck to the surface of the pressing rotary member, thereby providing a high quality image forming apparatus.

Further, in the normal operation of the image forming apparatus, since the surface of the pressing rotary member can be cleaned by utilizing the recording material being conveyed, any cleaning member can be omitted, and an exchanging operation of the cleaning member and any mechanism for exchanging the cleaning member are not required.

Second embodiment

Figure 3:
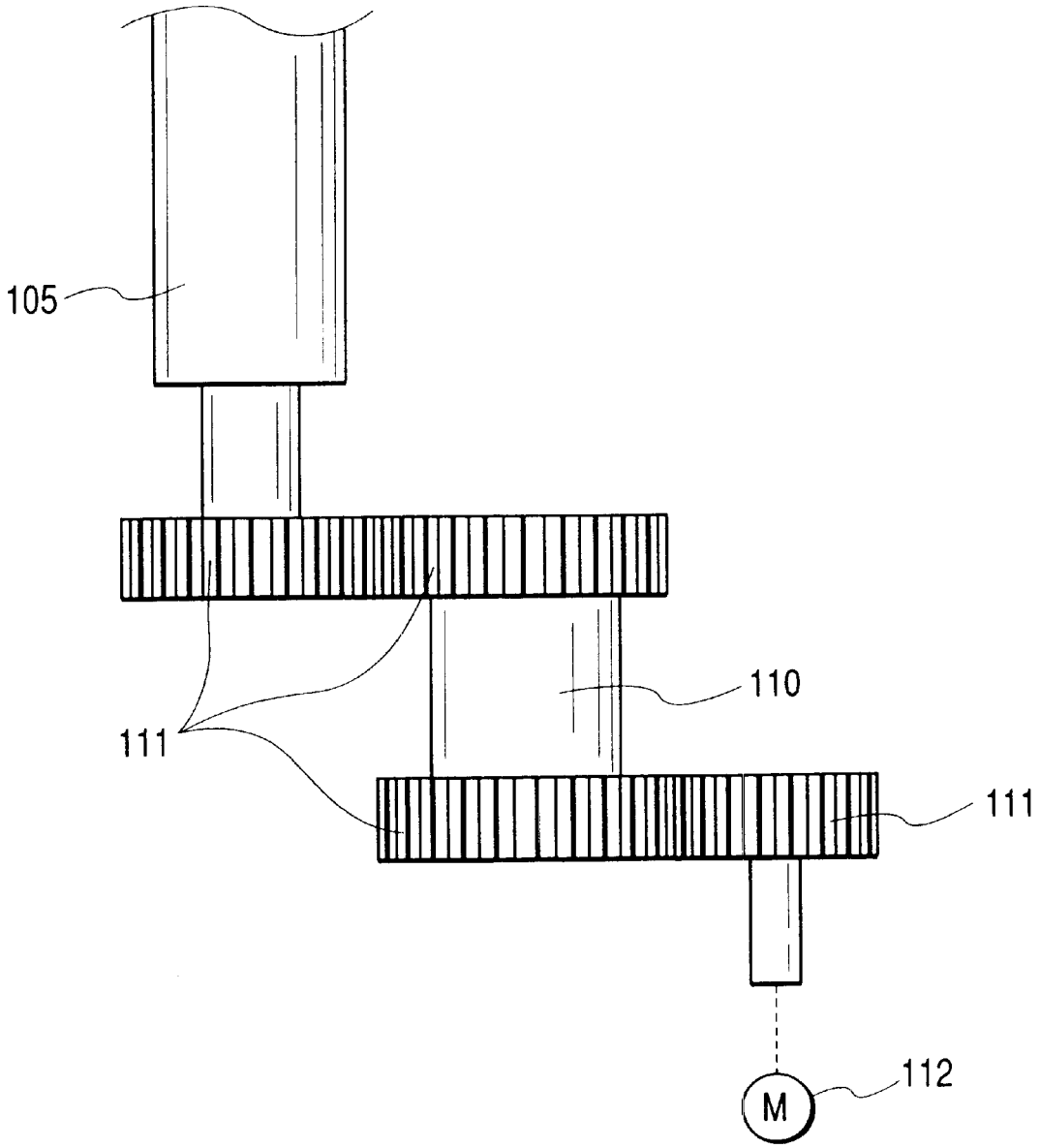
FIG. 3 is an explanatory view for a torque limiter.
Figure 4:
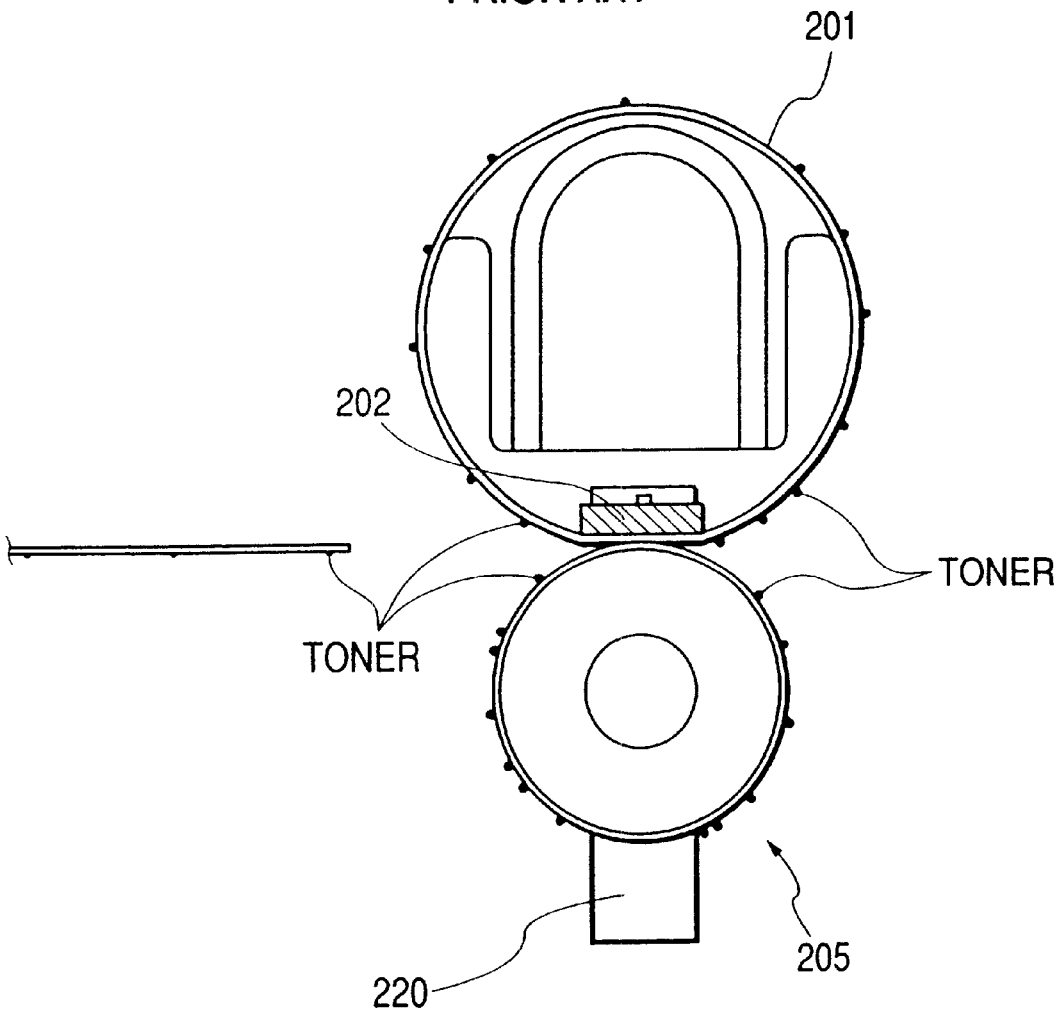
FIG. 4 PRIOR ART
FIG. 4 is a view showing a fixing apparatus as a background art of the present invention.

FIG. 3 shows a second embodiment of the present invention. Although a fundamental construction of the second embodiment is the same as that of the first embodiment, as shown in FIG. 3, in the second embodiment, a pressing roller 105 is driven through a torque limiter 110. Incidentally, since the other constructions and functions are the same as those in the first embodiment, the same elements as those in the first embodiment are designated by the same reference numerals and explanation thereof will be omitted.

Gears 111 serve to drive the pressing roller 105.

The greater the tension on the recording material 8 applied by the fixing apparatus 10 the greater the effect for preventing the toner from being stuck to the surface of the pressing roller 105. However, the faster the speed Vr in the fixing nip portion N2 the faster the conveying speed of the recording material 8, with the result that there arises a problem that the image is elongated or blurred in the transfer portion.

Further, since the pressing roller 105 comprises the silicone rubber, if the temperature is increased, the roller will be thermally expanded. In the fixing apparatus 10 according to the illustrated embodiment, when the apparatus is continuously used, the temperature of the pressing roller is gradually increased, and the diameter of the roller is ultimately increased by about 4%. Thus, the tension on the recording material 8 applied by the fixing apparatus 10 is increased.

Thus, in order to prevent the toner from being stuck to the surface of the pressing roller 105 and to avoid the problem that the image is blurred, it is preferable that the relative speed between the speed Vt at the transfer portion and the speed Vr at the fixing portion is regulated within a certain range.

To this end, in the illustrated embodiment, the torque limiter 110 is provided in a path between the drive motor 112 and the pressing roller 105 to drive the pressing roller 105 through the torque limiter 110. As a result, even if the pressing roller 105 tries to pull the recording material 8, since the torque limiter 110 is operated to prevent that a force greater than a predetermined value is applied to the recording material 8, the image distortion due to over-tension can be prevented.

For example, if the torque limiter 110 is not used, in order to prevent the over-tension by the fixing apparatus 10, the diameter of the pressing roller had to be 20 mm±0.1 mm. To the contrary, when the torque limiter 110 is used, the diameter may be 20 mm−0.1 mm to 20 mm±0.8 mm, with the result that margin of the tolerance range can be increased, from 0.2 mm to 0.9 mm, by about 4 times.

Similarly, the tolerance of the diameter of the transfer roller can be increased.

Incidentally, since the driving torque of the fixing apparatus 10 according to the illustrated embodiment is about 2 kg, the operating torque of the torque limiter 110 is set to about 3 to 4 kg.

As mentioned above, by driving the pressing roller 105 through the torque limiter 110, it is not required that the relative speed between the speed Vt at the transfer portion and the speed Vr at the fixing portion be regulated with high accuracy, and, thus, for example, if a pressing roller or a transfer roller having certain dispersion is used, the image distortion due to thermal expansion can be prevented and the toner can be prevented from being stuck to the surface of the pressing roller.

In this way, according to the illustrated embodiment, the same effect as the first embodiment can be achieved, and, further, by providing the torque limiter, since the image distortion due to the over-tension by the pressing rotary member can be prevented, the developer can be prevented from being stuck to the surface of the pressing rotary member and the stable image without image blur can be obtained, regardless of the dispersion in the relative conveying speed between the transfer portion and the fixing portion.

While the present invention was explained with reference to the specific embodiments, the present invention is not limited to such embodiments, but alterations and modifications can be made within the scope of the invention.

What is claimed is:

1. An image forming apparatus comprising:

an image bearing member for bearing an image;

a transferring member for forming a transfer nip portion between said image bearing member and said transferring member, wherein a recording material is pinched and conveyed and an image on said image bearing member is transferred onto the recording material in said transfer nip portion, a rotary member contacted with the image on the recording material;

a driving roller for forming a fixing nip portion between said rotary member;

driving means for driving said driving roller; and a torque limiter provided between said driving roller and said driving means, wherein the recording material bearing the image is pinched and conveyed and the image is fixed to the recording material in said fixing nip portion, wherein regarding at least a recording material having a maximum size, while the image is being transferred in said transfer nip portion, the image is fixed in said fixing nip portion, and wherein a peripheral speed of said driving roller is always greater than a conveying speed of the recording material in said transfer nip portion.

2. An image forming apparatus according to claim 1, wherein said driving roller is provided at its surface with a mold releasing layer.

3. An image forming apparatus according to claim 2, wherein said mold releasing layer is a fluororesin layer.

4. An image forming apparatus according to claim 1, further comprising a heating body, wherein said rotary member comprises a film slidingly contacted with said heating body.

5. An image forming apparatus according to claim 4, wherein said heating body and said driving roller are urged against each other via said film.

* * * * *

UNITED STATES PATENT AND TRADEMARK OFFICE

CERTIFICATE OF CORRECTION

PATENT NO. : 6,366,745 B1
DATED : April 2, 2002
INVENTOR(S) : Nobukazu Adachi et al.

It is certified that error appears in the above-identified patent and that said Letters Patent is hereby corrected as shown below:

Column 1,
Line 15, “born” should read -- borne --.
Line 27, “plate” should read -- place --.

Column 2,
Line 3, “Even” should read -- Especially --.

Column 5,
Line 2, “born” should read -- borne --.
Line 66, “not to” should read -- and so do not --.

Signed and Sealed this

Fourth Day of June, 2002

*Attest:*

*Attesting Officer*

JAMES E. ROGAN
*Director of the United States Patent and Trademark Office*